US009745866B2

(12) United States Patent
Nakano et al.

(10) Patent No.: US 9,745,866 B2
(45) Date of Patent: Aug. 29, 2017

(54) MOISTURE SEPARATOR UNIT FOR STEAM TURBINE AND STEAM-TURBINE STATIONARY BLADE

(71) Applicant: Mitsubishi Hitachi Power Systems, Ltd., Yokohama, Kanagawa (JP)

(72) Inventors: Susumu Nakano, Yokohama (JP); Koji Ishibashi, Yokohama (JP); Kenjiro Narita, Yokohama (JP); Takeshi Kudo, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 373 days.

(21) Appl. No.: 14/448,462

(22) Filed: Jul. 31, 2014

(65) Prior Publication Data

US 2015/0037144 A1 Feb. 5, 2015

(30) Foreign Application Priority Data

Aug. 1, 2013 (JP) ..... 2013-160102

(51) Int. Cl.
*F01D 25/32* (2006.01)
*F01D 9/02* (2006.01)
(Continued)

(52) U.S. Cl.
CPC ..... *F01D 25/32* (2013.01); *F01D 5/14* (2013.01); *F01D 9/02* (2013.01); *F01D 9/041* (2013.01);
(Continued)

(58) Field of Classification Search
CPC ... F01D 5/14; F01D 5/28; F01D 5/146; F01D 5/147; F01D 25/32; F01D 9/02; F01D 9/041; F05D 2220/31; F05D 2260/609
See application file for complete search history.

(56) References Cited

U.S. PATENT DOCUMENTS 2,271,900 A * 2/1942 Mowbray ..... B07B 1/48 209/403
3,697,191 A * 10/1972 Heymann ..... F01D 5/18 415/169.3
(Continued)

FOREIGN PATENT DOCUMENTS

JP 58-176404 A 10/1983
JP 1-110812 A 4/1989
(Continued)

OTHER PUBLICATIONS

Machine Translation of JP08-200007 A [retrieved on Oct. 4, 2016], Retrieved from: Japan Platform for Patent Information.*
(Continued)

*Primary Examiner* — Nathaniel Wiehe
*Assistant Examiner* — Eric Zamora Alvarez
(74) *Attorney, Agent, or Firm* — Crowell & Moring LLP

(57) ABSTRACT

A steam turbine stationary blade is configured to be a stationary blade structure having a hollow structure. The steam turbine stationary blade is provided with a slit disposed on a stationary blade surface. The pressure of a stationary blade hollow is reduced to suction a liquid film through the slit for removing the liquid film formed on the stationary blade surface. An opening portion of the slit is covered with a sheet in a meshed pattern formed of a fine mesh thereby reducing an accompanied steam amount so as to effectively remove the liquid film.

11 Claims, 5 Drawing Sheets

(51) Int. Cl.
*F01D 5/14* (2006.01)
*F01D 9/04* (2006.01)

(52) U.S. Cl.
CPC .... *F05D 2220/31* (2013.01); *F05D 2260/609* (2013.01)

(56) References Cited

U.S. PATENT DOCUMENTS

| | | | | |
|---|---|---|---|---|
| 4,274,804 | A * | 6/1981 | Teshima | F01D 25/32 415/121.2 |
| 4,948,335 | A * | 8/1990 | Silvestri, Jr. | F01K 7/223 415/168.1 |
| 5,494,405 | A * | 2/1996 | Gray | F01D 25/32 415/211.2 |
| 6,007,296 | A | 12/1999 | Ernst et al. | |
| 6,305,902 | B1 * | 10/2001 | Konishi | F01D 25/32 415/115 |
| 7,789,618 | B2 * | 9/2010 | Burdgick | F01D 25/32 415/169.4 |
| 2007/0014670 | A1 | 1/2007 | Maeno | |

FOREIGN PATENT DOCUMENTS

| | | | |
|---|---|---|---|
| JP | 8-200007 | A | 8/1996 |
| JP | 8-240104 | A | 9/1996 |
| JP | 2007-23895 | A | 2/2007 |

OTHER PUBLICATIONS

Machine Translation of JP08-240104 A [retrieved on Oct. 4, 2016], Retrieved from: Japan Platform for Patent Information.*
European Search Report issued in counterpart European Application No. 14179482.6 dated Apr. 9, 2015 (Six (6) pages).

* cited by examiner

MOISTURE SEPARATOR UNIT FOR STEAM TURBINE AND STEAM-TURBINE STATIONARY BLADE

CLAIM OF PRIORITY

The present application claims priority from Japanese Patent application serial no. 2013-160102, filed on Aug. 1, 2013, the content of which is hereby incorporated by reference into this application.

TECHNICAL FIELD

The present invention relates to a moisture separator unit for a steam turbine and a steam-turbine stationary blade. In particular, the present invention relates to a moisture separator unit that removes a liquid film generated on a stationary-blade surface or a liquid film attached to a turbine casing so as to reduce moving blades erosion due to on collision of droplets generated by wet steam.

BACKGROUND ART

In the last stage of a low pressure turbine or in a stage one or two stages before the last stage, the pressure is typically very low. Accordingly, the working fluid is in a wet steam state containing liquefied fine droplets (liquid droplet nuclei). The liquid droplet nuclei that are condensed and attached to the blade surface are combined together, so as to form a liquid film on the blade surface. Further, the liquid film is torn apart due to the mainstream steam and is sprayed into the downstream as coarse droplets that are far larger than the liquid droplet nuclei at the beginning. Although these coarse droplets are slightly scaled down by the mainstream steam afterward, the coarse droplets flow down while keeping certain sizes. The coarse droplets cannot rapidly turn along the flow passage like a steam due to their inertial forces, and collide with the moving blade in the downstream at high speed. This causes erosion in which the blade surface is eroded or causes a loss due to interference of the rotation of the turbine blade. In contrast, conventionally, in order to prevent an erosive action by an erosion phenomenon, the tip portion of the moving-blade leading edge is coated with a shield material. The shield material is made of a material that is hard and has a high strength, for example, stellite. Alternatively, there is a method in which various unevenness processing is performed on the surface of the leading edge portion of the blade to form a rough surface so as to reduce the impact force during collision of the droplets. However, the shield material cannot always be disposed due to the processability. Since only protecting the blade surface is not generally perfect as an erosion countermeasure, another method of the erosion countermeasure is usually used in combination.

Generally, to reduce the influence of the erosion, it is most effective to remove the droplets themselves. For example, Patent Literature 1 (JP-A No. Hei 1-110812) discloses a method to remove the droplets. In the method, the stationary blade employs a hollow stationary turbine blade and slits are disposed on the blade surface. By reducing the pressure inside of the hollow stationary turbine blade, the liquid film is suctioned. These slits are often directly processed on the blade surface of a stationary-blade structure with a hollow structure. Additionally, as disclosed in Patent Literature 2 (JP-A No. 2007-23895), there is a method for processing a slit portion as a separate member to mount the slit portion on the stationary blade. Additionally, Patent Literature 3 (JP-A No. Hei 8-240104) discloses a method in which a porous cover is disposed at an opening formed in the guide vane of the steam turbine, all capillaries of the porous cover are filled with liquid to be suctioned, and a wall withstanding the application of the negative pressure is formed by the porous cover and the capillaries filled with liquid such that the liquid penetrates the portion wet with the liquid on the wall.

CITATION LIST

Patent Literature

[Patent Literature 1] JP-A No. Hei 1-110812
[Patent Literature 2] JP-A No. 2007-23895
[Patent Literature 3] JP-A No. Hei 8-240104

SUMMARY OF INVENTION

Technical Problem

To remove the liquid film formed on the stationary-blade surface, as disclosed in Patent Literatures 1 and 2, the stationary-blade structure with the hollow structure is used. By reducing the pressure of the stationary-blade hollow, the liquid film is suctioned through the slits disposed on the blade surface. In this case, in order to effectively remove the liquid film, the internal pressure of the hollow is reduced more so as to suction the liquid film. Generally, the liquid film formed on the blade surface has a thickness of several tens μm, and is formed as a layer extremely thin compared with the slit width. Increasing the liquid-film suction amount by reduction of the reduced suction pressure simultaneously causes suctioning of the steam that flows accompanying the liquid film flow. The steam flow to be trapped by the slit portion does not work on the turbine. Therefore, the output of electric generation of the turbine is reduced by the suctioned steam amount.

In Patent Literature 3, the wall withstanding the application of the negative pressure is formed by the porous cover and the capillaries filled with liquid. Accordingly, this wall allows the liquid to penetrate but does not have permeability with respect to the steam. However, in Patent Literature 3, a porous body formed of a sintered body is used. Furthermore, the porosity is approximately 25%. Accordingly, effectively suctioning and removing the liquid film is considered to be difficult.

An object of the present invention is to provide a moisture separator unit for a steam turbine and a steam-turbine stationary blade that can reduce an accompanied steam amount to effectively remove a liquid film.

Solution to Problem

According to the present invention, in a moisture separator unit for performing liquid film separation using vacuum suction by a slit disposed in a stationary-blade surface or similar portion of a steam turbine, the slit has an opening portion covered with a fine mesh sheet.

Advantageous Effects of Invention

The present invention can reduce the accompanied steam amount so as to effectively remove the liquid film.

The problem, configuration, and effect other than those described above are clarified by the description of the following embodiments.

DESCRIPTION OF EMBODIMENTS

Figure 1:
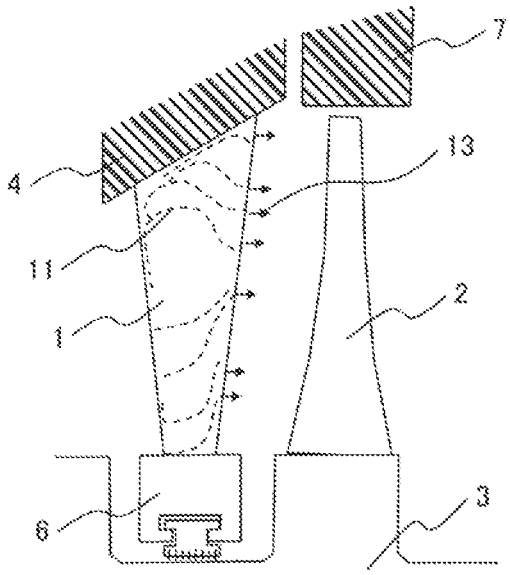
FIG. 1 is a schematic diagram illustrating a stage of a steam turbine and a state of a liquid film flowing on a stationary-blade surface.
Figure 2:
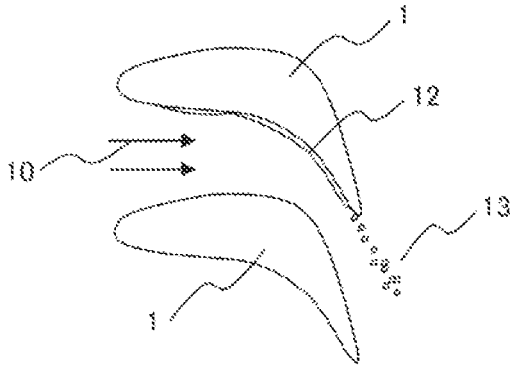
FIG. 2 is a cross-sectional view of an inter-blade flow passage schematically illustrating a state where droplets are scattered from a liquid film that has grown on the stationary-blade surface of the steam turbine.

Firstly, a description will be briefly given of a state where a liquid film and droplets are generated on a turbine-blade surface using FIG. 1 and FIG. 2.

FIG. 1 is a schematic diagram illustrating a stage of a conventional steam turbine and a flowing state of a liquid film that has grown on a wall surface of a stationary blade in the stage. The turbine stage of the steam turbine includes a stationary blade 1 and a moving blade 2. The stationary blade 1 is secured to an outer periphery-side diaphragm 4 and an inner periphery-side diaphragm 6. The moving blade 2 is disposed at the downstream side in the flow direction of a working fluid in the stationary blade 1, and is secured to a rotor shaft 3. On the outer periphery side of the tip of the moving blade 2, a casing 7 that constitutes a wall surface of a flow passage is disposed. This configuration increases the speed of the steam main flow that is the working fluid during passage through the stationary blade 1 and provides energy to the moving blade 2, so as to rotate the rotor shaft 3.

In a low pressure turbine or similar turbine, in the case where the steam main flow that is the working fluid goes into a wet steam state, the droplets contained in the steam main flow are attached to the stationary blade 1. These droplets gather on the blade surface so as to form a liquid film. This liquid film flows in the direction of the force determined by the resultant force of the pressure and the shear force at the interface with the steam, and moves to the vicinity of the trailing edge end of the stationary blade 1. FIG. 1 illustrates a flow 11 of the moving liquid film. The droplets that have moved to the vicinity of the trailing edge end of the blade become droplets 13, and are scattered toward the moving blade 2 together with the steam main flow.

FIG. 2 is a cross-sectional view of an inter-blade flow passage schematically illustrating a state where droplets are scattered from a liquid film that has grown on the blade surface of the stationary blade 1. When a steam 10 passes through the stationary blades 1, droplets are attached to the stationary blade 1 and the droplets gather on the stationary-blade surface so as to grow to be a liquid film 12. The liquid film 12 that has grown on the blade surface of the stationary blade 1 moves to the blade trailing edge end, and is scattered from the blade trailing edge end as the droplets 13. The scattered droplets 13 collide with the moving blade 2 disposed in the downstream. This causes erosion in which the moving-blade surface is eroded or causes a loss due to interference of the rotation of the moving blade 2.

Figure 3:
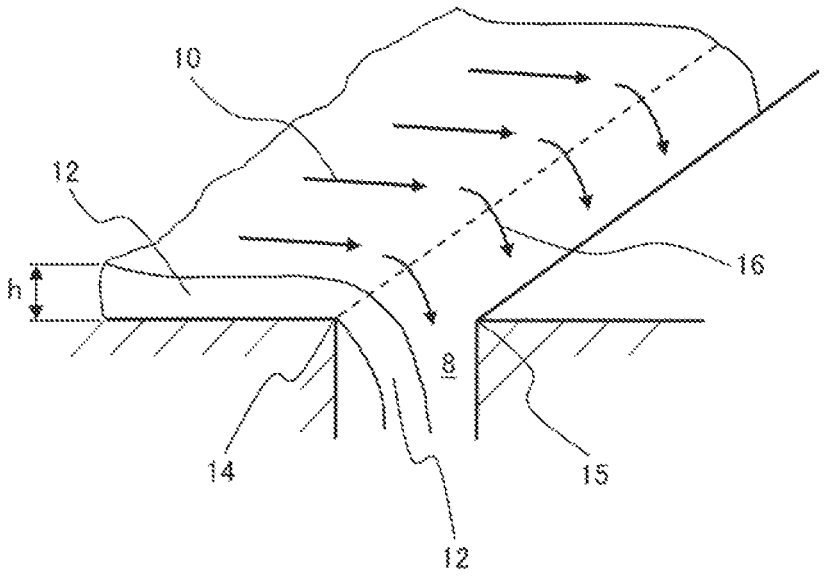
FIG. 3 is a diagram schematically illustrating flowing states of a liquid film and a steam flow in a moisture-separator slit portion.

FIG. 3 is a perspective cross-sectional view of a slit 8 for moisture separation disposed on the stationary-blade surface, and is a diagram schematically illustrating the states of the flow of the liquid film 12 and the flow of the steam 10 in the slit portion in the case where the flow of the liquid film 12 is vacuum-suctioned by the slit 8. The liquid film flow has a thickness h thinner than the slit width. Accordingly, the flow of the liquid film 12 does not reach a rear edge portion 15 of the slit 8 and the steam flow 16 is suctioned to the inside of the slit 8 by vacuum suction.

Based on the above description, embodiments of the present invention will be described in detail below with reference to the drawings as necessary. Like reference numerals designate corresponding or identical elements throughout the respective drawings including FIG. 1 to FIG. 3.

First Embodiment

A description will be given of a first embodiment according to the present invention. According to the first embodiment of the present invention, a moisture separator unit includes a slit on a stationary-blade surface of a hollow stationary turbine blade, and separates the liquid film by vacuum suction. The slit includes an opening portion (an opening portion on the stationary-blade surface) covered with a sheet in a meshed pattern formed by a fine mesh.

Figure 4:
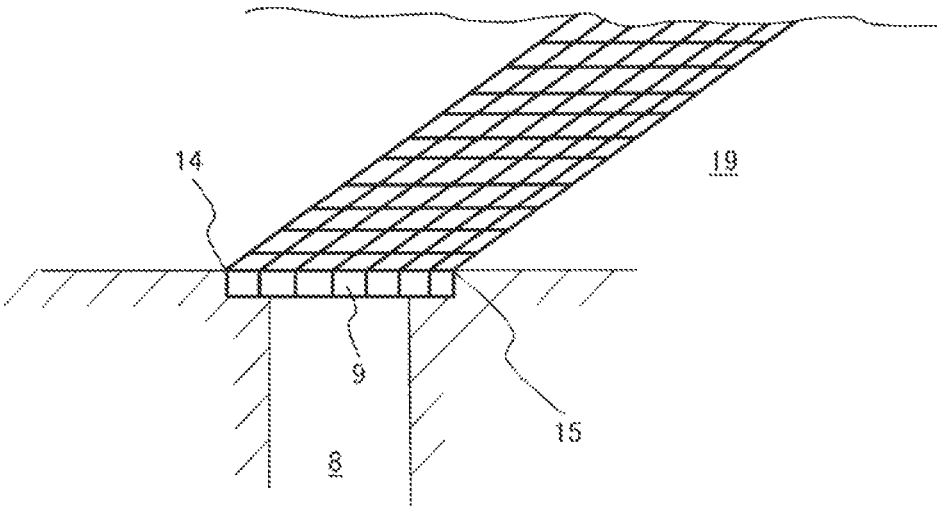
FIG. 4 illustrates a moisture separator unit according to a first embodiment of the present invention, and is a schematic diagram illustrating a slit structure in the moisture separator unit processed on the stationary-blade surface of the steam turbine.

FIG. 4 is a schematic diagram of a slit structure in the moisture separator unit according to this embodiment. As illustrated in FIG. 4, a fine mesh sheet 9 in a meshed pattern formed by a fine mesh is disposed to cover the entire region of the opening portion of the slit 8 for moisture separation disposed in the stationary blade. A housing portion with a thickness corresponding to the sheet thickness is formed on the stationary-blade surface side of the slit 8 so as to have the surface of the fine mesh sheet 9 and the stationary-blade surface on a flat surface. In this embodiment, the fine mesh sheet 9 is made of metal. The mesh width of the fine mesh sheet 9 is several tens μm. The fine mesh sheet 9 is formed to have a thickness of, for example, about 0.5 to 1.0 mm.

Figure 5:
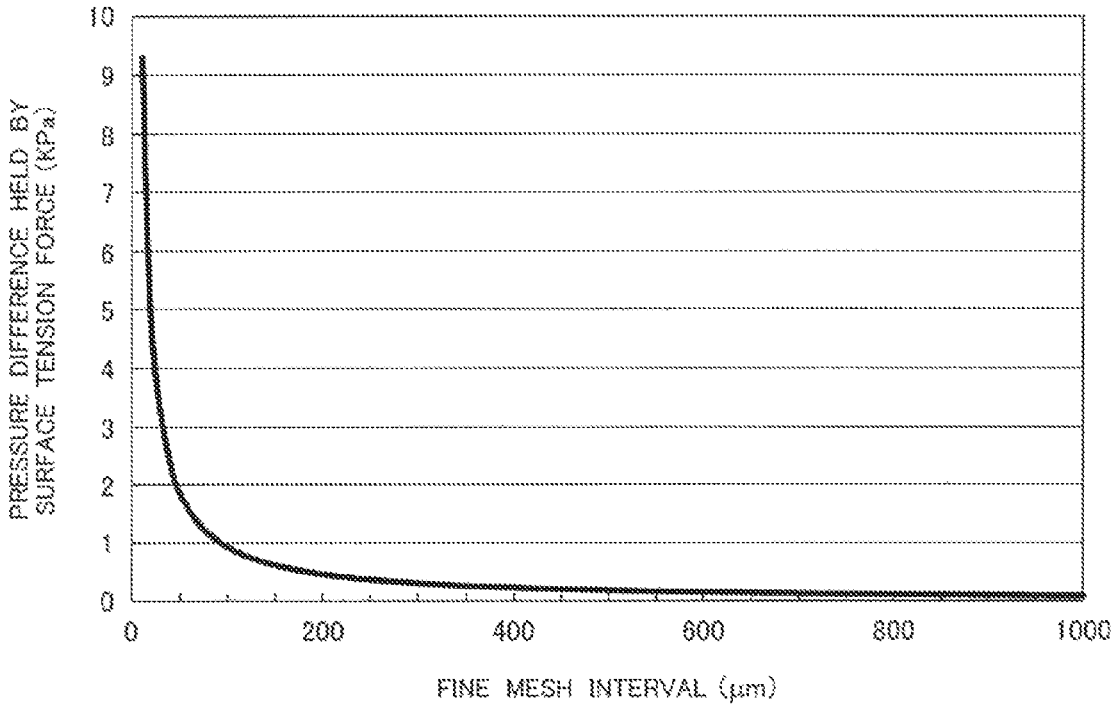
FIG. 5 is a graph illustrating a mesh interval of a fine mesh sheet and a pressure difference held by a surface tension force generated in a fine mesh portion of the fine mesh sheet.

FIG. 5 is a graph illustrating a pressure difference that is held by the surface tension force generated by the fine mesh sheet 9 disposed at the slit 8 in the moisture separator unit according to this embodiment, and a graph illustrating the relationship between the mesh width and the pressure difference that is held by the surface tension force of the liquid film filled between the mesh intervals. For example, the static pressure of the stationary-blade surface in the low-pressure last stage of the steam turbine is about 10 to 20 kPa.

Assuming that the internal pressure of the hollow stationary turbine blade is reduced to approximately 0.9 times the pressure on the stationary-blade surface so as to suction the liquid film, a pressure difference of 1 to 2 kPa held by a surface tension force is equal to the pressure difference in the pressure reduction for liquid film suctioning. This means that formation of a surface with the surface tension force holding the pressure difference of 1 to 2 kPa on the top surface of the slit allows holding the pressure difference between the inside and the outside of the slit. In accordance with FIG. 5, it is only necessary to provide a width of about 50 to 100 μm so as to generate a surface tension force of 1 to 2 kPa between the mesh intervals. In other words, the fine mesh sheet 9 is formed of the fine mesh in which the surface tension force that can hold the pressure difference in the pressure reduction for liquid film suctioning is generated. In this case, taking into consideration the ease of suctioning the liquid film, clogging, and similar parameter, the mesh interval is preferred to be wider as long as the pressure difference in the pressure reduction for liquid film suctioning can be held.

Figure 6:
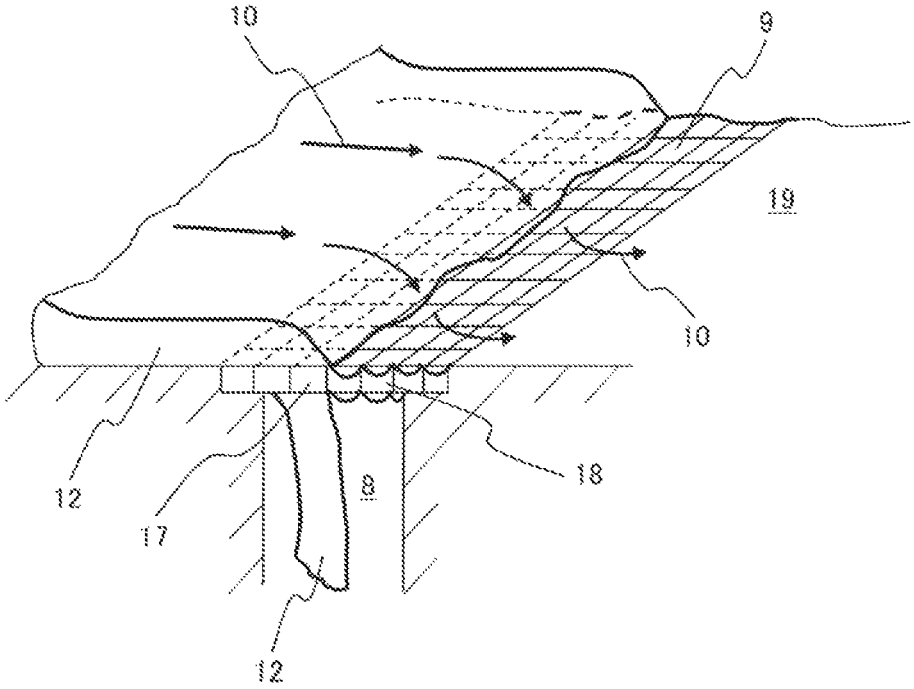
FIG. 6 illustrates the moisture separator unit according to the first embodiment of the present invention, and is a diagram describing suction removal of a liquid film and reduction of an accompanied steam amount in the moisture separator unit processed on the stationary-blade surface of the steam turbine.

FIG. 6 is a diagram schematically illustrating the states of the flow of the liquid film 12 and the flow of the steam 10 in the slit 8 according to this embodiment. As illustrated in FIG. 6, when the liquid film 12 flows to once wet the surface of the fine mesh sheet 9, the liquid permeates through the fine mesh to wet the entire region of the sheet surface. In a sheet portion 17 that is a portion immersed in the flow of the liquid film, the fine mesh sheet is immersed in the liquid film. Accordingly, the surface tension force by the fine mesh sheet 9 is not generated and the water passes through the sheet surface and is suctioned to the inside of the slit. On the other hand, in a sheet portion 18 in which the liquid film flow does not pass, the surface tension force by the moisture that has permeated through the mesh cuts off the airflow flowing into/out of the inside and the outside of the slit. The steam flow flowing on the blade surface is not suctioned to the inside of the slit. That is, the liquid film flow flowing on the blade surface is suctioned to a stationary-blade hollow portion by vacuum suction using the slit. However, in the slit rear portion in which the liquid film flow does not pass, some of the liquid film flow wets the fine mesh sheet surface and the intermesh space of the fine mesh sheet surface is filled with moisture. In the liquid film attached to the mesh, a surface tension force acting on the periphery of the fine mesh is generated. In the case where this surface tension force is larger than the suction pressure, the fine mesh sheet does not suction the steam flow to the inside of the stationary-blade hollow.

Thus, the present invention reduces the accompanied steam using the surface tension force generated on the fine mesh sheet. The present invention is different from the technique using the capillary action disclosed in Patent Literature 3. In the porous body formed of the sintered body disclosed in Patent Literature 3, the surface tension force cannot be used like the fine mesh sheet of the present invention.

Figure 7:
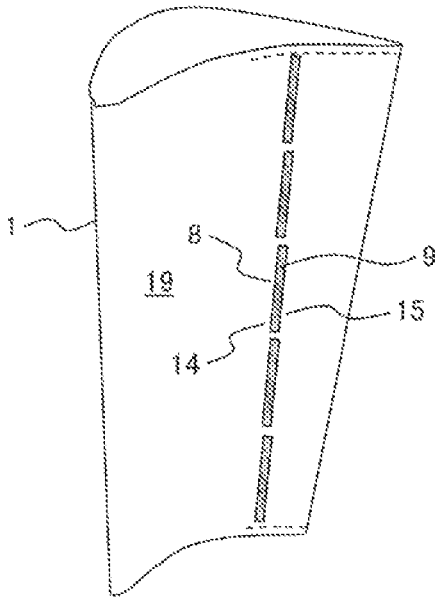
FIG. 7 is a schematic diagram illustrating a stationary blade on which the moisture separator unit of the steam turbine according to the present invention is provided.

FIG. 7 is a schematic perspective view of the stationary blade to which the moisture separator unit according to this embodiment is applied. As illustrated in FIG. 7, the fine mesh sheet 9 is mounted on the slit 8 disposed on the back side (downstream) of a blade surface 19 on the pressure surface side of the stationary blade 1. In the mounting of the fine mesh sheet 9 on the blade surface 19, as illustrated in FIG. 4 or FIG. 6, thickness differences (steps) corresponding to the sheet thickness are provided in a front edge portion 14 and a rear edge portion 15 of the slit 8. In these thickness difference portions, the fine mesh sheet 9 and the blade surface 19 are secured together by brazing or welding.

With this embodiment, in the case where the slit 8 is disposed on the blade surface 19 of the stationary blade 1 to vacuum-suction the liquid film 12 generated on the blade surface, the fine mesh sheet 9 installed on the slit surface provides the effect that can reduce the accompanied steam amount without affecting separation of the liquid film. This also provides the effect that can prevent reduction in turbine electric generation efficiency due to the flow volume of the accompanied steam and can reduce the moving blades erosion due to the liquid film separation so as to enhance the reliability of the turbine.

Second Embodiment

Next, a second embodiment of the present invention will be described using FIG. 8. Similarly to the first embodiment, the present invention is applicable to a portion (stationary portion) in contact with a steam flow to generate a liquid film. This embodiment is an example for removing the liquid film flow attached to the outer periphery-side diaphragm 4 of the stationary blade 1. Similarly to the stationary-blade surface, a liquid film is attached to the outer periphery-side diaphragm 4 of the stationary blade 1 illustrated in FIG. 1. This liquid film flows to the downstream side together with the steam flow. Here, a part of the liquid film attached to the outer periphery-side diaphragm 4 drops from the outer periphery-side diaphragm 4 and collides with the moving blade 2. The droplets dropping from the outer periphery-side diaphragm 4 are large droplets, thus having a considerable influence on the moving blades erosion.

Figure 8:
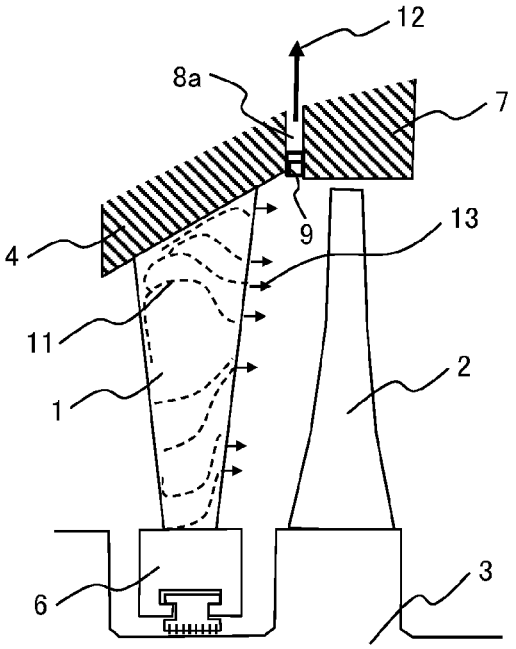
FIG. 8 is a diagram illustrating a state where the moisture separator unit of the steam turbine according to the present invention is provided on a turbine casing (in a second embodiment).

In FIG. 8, the moisture separator unit consists of the slit **8*a* and the fine mesh sheet 9, which is similar to the moisture separator unit illustrated in FIG. 4, are installed on a reduced pressure-side inlet between the outer periphery-side diaphragm 4 and the casing 7. The moisture separator unit is arranged in a ring shape. The moisture separator unit separates the inside and the outside of the turbine casing from each other. Between the inside and the outside, the slit 8*a* covered with the fine mesh sheet 9** is disposed. The outside of this moisture separator unit is vacuum-suctioned compared with the inside of the turbine casing, so as to remove the moisture attached to the outer periphery-side diaphragm. With the surface tension force of the liquid film formed between the fine mesh intervals, the steam flow flowing the inside of the turbine casing is not suctioned or removed toward the outside of the casing.

This embodiment can remove the liquid film flow attached to the outer periphery-side diaphragm at the outer periphery of the stationary blade and additionally reduce the accompanied steam amount. Accordingly, this provides the effect that can prevent reduction in turbine efficiency due to the accompanied steam amount and can reduce the moving blades erosion due to the liquid film separation so as to enhance the reliability of the turbine.

While in this embodiment the moisture separator unit consisted of the slit **8*a* and the fine mesh sheet 9 is installed between the outer periphery-side diaphragm 4 and the casing 7, a slit may be formed in a position close to the casing of the outer periphery-side diaphragm 4** and a fine mesh sheet may be installed to cover the slit.

Third Embodiment

Figure 9:
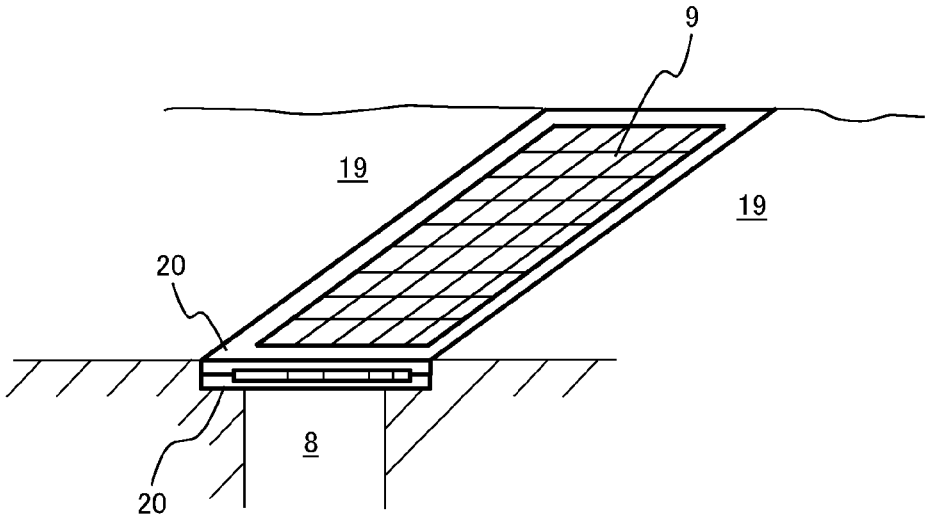
FIG. 9 is a moisture separator unit according to a third embodiment of the present invention, and is a schematic diagram of the moisture separator unit processed on a stationary-blade surface of a steam turbine.

Next, a third embodiment of the present invention will be described using FIG. 9. In the embodiment illustrated in FIG. 4, the fine mesh sheet 9 is mounted on the blade surface 19 by brazing or welding. In the embodiment illustrated in FIG. 9, the fine mesh sheet is preliminarily sandwiched by two metal plates 20 so as to be integrally formed. This fine mesh sheet is mounted on the slit 8 of the stationary blade 1 or the slit 8*a* between, for example, the outer diaphragm and the casing. The frame portion of the integrated metal plates 20 can be used to fasten the fine mesh sheet onto the casing or the blade surface by bolts or welding. While in the first embodiment and the second embodiment the fine mesh sheet 9 employs a metallic material, the sheet material is not limited to metal in the case where the method according to this embodiment is used as a securing method for the fine mesh sheet. The sheet material may be a material such as a plastic fiber insofar as the fine mesh is formed.

This embodiment expands selectivity of mounting means for the fine mesh sheet, in addition to the effects of the above-described embodiments. This provides the effect that can extend the mounting area of the liquid film separator unit not only to the blade surface but also to the casing or similar portion.

Fourth Embodiment

Next, a fourth embodiment of the present invention will be described. In the embodiments illustrated in FIG. 4 to FIG. 8, the fine mesh sheet 9 employs the mesh with the mesh interval of 50 to 100 μm. In this embodiment, what is called a foam metal is used. In the foam metal, foam is formed inside of a metallic base material so as to form a fine mesh structure inside of the metal. The thickness of the metal plate can be formed to have 0.5 to 1.0 mm, which is equal to the thickness of the mesh, and the spatial region formed by the foam formation is also formed to have several tens μm.

This embodiment can form a microstructure with a mesh spacing of several tens μm or less and can keep a high space ratio equal to or more than 80% in the metal plate. This provides the effect that can reduce the resistance of the passing liquid and generate a high surface tension force.

The present invention is not limited to the above-described embodiments, and includes various modifications. For example, the above-described embodiments are described in detail for simply describing the present invention, and do not necessarily include all the described configurations. Apart of the configurations of one embodiment can be replaced by the configuration of another embodiment. A part of the configurations of one embodiment can be used with the addition of the configuration of another embodiment. Regarding a part of the configurations in the respective embodiments, another configuration can be added, deleted, or replaced.

REFERENCE SIGNS LIST

1 stationary blade
2 moving blade
3 rotor shaft
4 outer periphery-side diaphragm
6 inner periphery-side diaphragm
7 casing
8 slit
9 fine mesh sheet
10 steam flow
11 liquid film flow
12 liquid film
13 droplet
14 front edge of slit portion
15 rear edge of slit portion
16 steam flow suctioned by slit
17 mesh portion in which liquid flow film pass
18 mesh portion in which liquid film flow does not pass
19 blade surface
20 metal plate

The invention claimed is:

1. A moisture separator unit for a steam turbine, the moisture separator unit being disposed in a stationary portion in contact with a steam flow to generate a liquid film, the moisture separator unit comprising:

a slit disposed in the stationary portion, wherein liquid film separation is performed by a vacuum suction through the slit, and a sheet formed of a fine mesh, wherein the sheet formed of the fine mesh covers an opening portion of the slit, wherein the sheet formed of the fine mesh has a mesh interval of 50 to 100 μm and a thickness of 0.5 to 1.0 mm.

2. The moisture separator unit for a steam turbine according to claim 1, wherein the sheet formed of the fine mesh is formed of a fine mesh configured to generate a surface tension force in the liquid film attached to the fine mesh, the surface tension force acts on a periphery of the fine mesh and allows holding a pressure difference in pressure reduction for the vacuum suction, wherein the sheet formed of the fine mesh has a sheet portion immersed in a flow of the liquid film, at which the surface tension force is not generated in the fine mesh by the flow of the liquid film, and the other sheet portion not immersed in the flow of the liquid film, at which an airflow flowing into/out of a inside and a outside of the slit is cut off by the surface tension force generated in the fine mesh.

3. The moisture separator unit for a steam turbine according to claim 2, wherein the stationary portion is a stationary-blade surface in a low-pressure last stage of the steam turbine.

4. The moisture separator unit for a steam turbine according to claim 1, wherein the sheet of the fine mesh has a structure that is sandwiched by two metal plates and is mounted on the stationary portion via the two metal plates.

5. The moisture separator unit for a steam turbine according to claim 1, wherein the sheet of the fine mesh is formed by a foam metal.

6. The moisture separator unit for a steam turbine according to claim 1, wherein the stationary portion is a blade surface of a stationary blade.

7. The moisture separator unit for a steam turbine according claim 1, wherein the stationary portion is a diaphragm on a stationary-blade outer periphery side.

8. The moisture separator unit for a steam turbine according to claim 7, wherein the slit disposed in the stationary portion is formed between the diaphragm on the stationary-blade outer periphery side and a turbine casing.

9. A steam-turbine stationary blade, the steam-turbine stationary blade having a hollow structure, comprising the moisture separator unit for a steam turbine according to claim 1 on a blade surface of the steam-turbine stationary blade.

10. A steam-turbine stationary blade, the steam-turbine stationary blade having a hollow structure, comprising the moisture separator unit for a steam turbine according to claim 4 on a blade surface of the steam-turbine stationary blade.

11. A steam-turbine stationary blade, the steam-turbine stationary blade having a hollow structure, comprising the moisture separator unit for a steam turbine according to claim 5 on a blade surface of the steam-turbine stationary blade.

* * * * *